United States Patent [19]

Haller

[11] Patent Number: 4,659,047

[45] Date of Patent: Apr. 21, 1987

[54] APPLIANCE SUPPORT

[75] Inventor: Walter Haller, Auckland, New Zealand

[73] Assignee: Robinson Industries, Limited, Auckland, New Zealand

[21] Appl. No.: 854,674

[22] Filed: Apr. 18, 1986

Related U.S. Application Data

[63] Continuation of Ser. No. 603,426, Apr. 24, 1984, abandoned.

[30] Foreign Application Priority Data

Mar. 22, 1984 [NZ] New Zealand ..... 207597

[51] Int. Cl.[4] ..... E04G 3/00

[52] U.S. Cl. ..... 248/274; 248/310

[58] Field of Search ..... 248/274, 310, 673, 201, 248/316.8, 235, 225.1; 211/90, 88, 87, 175, 189

[56] References Cited

U.S. PATENT DOCUMENTS

| | | | |
|---|---|---|---|
| 1,679,838 | 8/1928 | McHugh et al. | 248/274 X |
| 1,690,910 | 11/1928 | Shapiro | 211/90 X |
| 1,955,485 | 4/1934 | Capra | 248/274 X |
| 2,035,301 | 3/1936 | Daugherty | 248/274 |
| 2,233,733 | 3/1941 | Clouse | 248/225.1 X |
| 2,365,252 | 12/1944 | Daum | 248/235 |
| 2,844,342 | 7/1958 | Anderson | 248/673 X |
| 3,129,819 | 4/1964 | Chandler | 211/90 X |
| 3,232,571 | 2/1966 | Josephson | 248/201 |
| 4,465,256 | 8/1984 | Wolbrink et al. | 248/201 X |

*Primary Examiner*—Ramon S. Britts
*Assistant Examiner*—David M. Purol
*Attorney, Agent, or Firm*—Holman & Stern

[57] ABSTRACT

This invention relates to an appliance support such as for example for supporting kitchen appliances, such as microwaves. This is by way of example only. The support includes an elongate brace member, which is adapted for attachment to a wall or similar surface. The elongate brace member includes an attachment plate and an outwardly extending support flange. At least two substantially "L" shaped support members are provided. These include an elongate and substantially upright portion and an outwardly extending base or foot portion. The support members are so formed and are attachable to the brace member, so that they extend outwardly from and below the brace member. The outwardly extending support flange of the brace member and at least an upper portion of the upright portion of each support member, are so formed and adapted relative to each other that the position of the support members is adjustable relative to each other and to the brace member.

2 Claims, 5 Drawing Figures

APPLIANCE SUPPORT

This is a continuation of application Ser. No. 603,426, filed Apr. 24, 1984, now abandoned.

BACKGROUND OF THE INVENTION

This invention relates to an appliance support.

Up until this time, various arrangements and suggestions have been made and put forward, for housing and locating appliances and similar articles, such as in kitchens, workshops and the like.

As will be appreciated space is often at a premium in kitchens, workshops and the like. It is thus desirable to provide a means of support for housing and locating appliances, implements and the like, which are able to be attached to a wall or similar surface, thus avoiding the need to take up valuable bench or existing shelf space. While the present invention is described by way of example only, and with reference to a shelf for an appliance such as a kitchen appliance, it should be appreciated that this is by way of example only. The present invention has equal application to use in workshops and garages, and indeed, in all rooms of a house or building where it is desired to store an appliance or article. It should be appreciated therefore, that the invention is not limited to the supporting of appliances such as kitchen appliances, microwaves and the like, or to use in such rooms as kitchens.

It has been found that the present invention is able to be attached to a wall or similar surface in a straight forward and efficient manner which allows the housing or mounting of an appliance or the like in a way in which it will be be unobtrusive yet aesthetically pleasing.

It is an object of this invention to provide a straight forward and efficient support for appliances and the like.

Other objects of the invention will become apparent from the following description.

SUMMARY OF THE INVENTION

According to one aspect of this invention there is provided an appliance support including an elongate brace member for attachment to a wall or similar surface, and including an attachment plate and an outwardly extending support flange; at least two support members being provided and each including an elongate and substantially upright portion and an outwardly extending base portion; the support members being so formed and attachable to said brace member, as to extend outwardly from said brace member; the outwardly extending support flange and at least an upper portion of the upright portion of each support member being so formed and adapted that the position of the support members is adjustable relative to each other and to the brace member.

BRIEF DESCRIPTION OF THE DRAWINGS

The invention will now be described by way of example only, and with reference to the accompanying drawings, wherein.

DETAILED DESCRIPTION OF PREFERRED EMBODIMENTS

Figures 1, 2, 3:
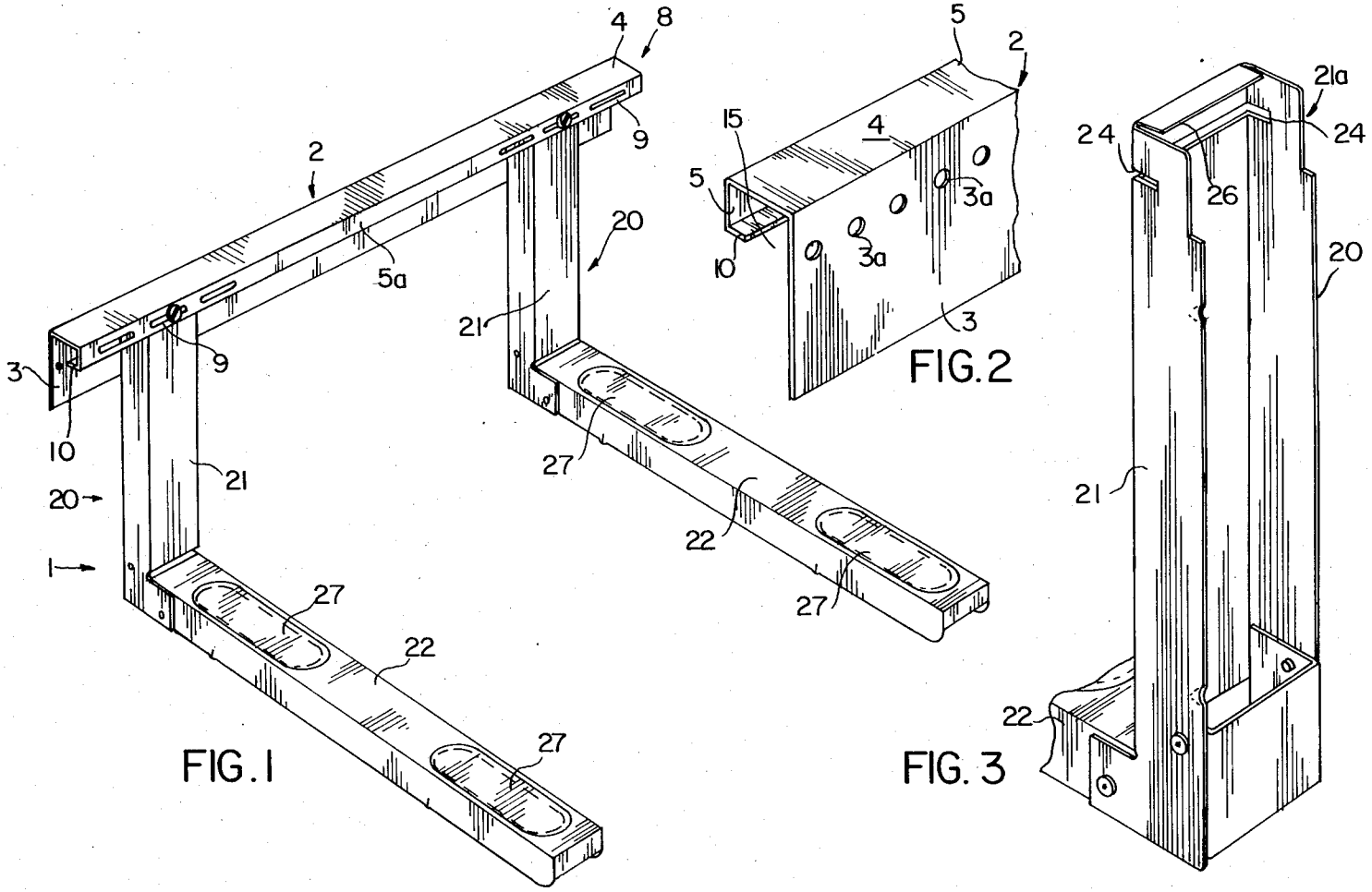
FIG. 1: is a general view of an appliance support according to one form of the present invention.
FIG. 2: is a sectional view of a brace member of the present invention.
FIG. 3: is a partial view of an upright of a support member according to one form of the present invention.
Figure 5:
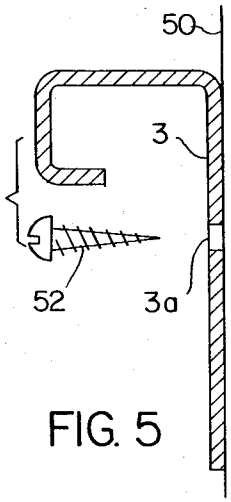
FIG. 5: is a cross sectional view of a brace member showing the manner of attachment thereof to a wall.

This invention will now be described by way of example only, and with reference to the accompanying drawings. The invention will be described with reference to the support being used as an appliance support, for supporting for example a microwave oven. This is however by way of example only. The invention can be used for other purposes as will be appreciated.

The support 1 of the present invention is preferably constructed of an appropriate metal material, although this is by way of example only. Any appropriate material can be used.

The support includes a brace member, generally shown at 2 in the accompanying drawings. The brace member 2 is adapted to be attached to a wall 50 or similar surface. The brace member 2 includes an attachment plate 3 being a flat elongate member, at the rear thereof, the attachment plate being provided with a plurality of holes 3*a* therein, to allow for screws or similar securing means to pass therethrough, for the purpose of allowing securing means to pass therethrough, for the purpose of attaching the brace members 2 to a wall or similar surface.

The attachment plate 3 then extends outwardly into a support flange 8, which has a main body portion 4 and then leads into a downwardly extending location portion 5.

As will be appreciated by the accompanying drawings, the downwardly extending attachment portion 5 extends downwardly from the main body 4 of the support flange 8 at substantially right angles to the longitudinal axis of the support flange 8.

As will be appreciated from the accompanying drawings, (and in particular FIG. 1), the front face 5A of the attachment plate is provided with a plurality of holes or slots 9 therein, the holes or slots 9 preferably being on each side. This enables support members 20 to be adjustably connected to the brace member 2 (as will be described hereinafter).

Referring further to FIGS. 1 and 2 of the accompanying drawings, the location portion 5 of the brace member 2 extends downwardly from the main body 4 of the support flange 8 for a short distance and then extends into a re-entrant or rail portion 10. The rail portion 10 extends inwardly of the location portion 5 and is substantially parallel to but spaced apart from and below an underside of the main body 4 of the support flange 8. The rail portion 10 only extends inwardly for a short distance from the location portion 5 so as to define a spacing or opening 15 within the brace member 2.

In use, suitable securing means (nails, screws, bolts and the like) are passed through holes 9 in the attachment plate 5 of the brace member 2 to attach the brace member 2 to a wall (not shown) so that the outwardly extending support flange 8 extends outwardly from the wall for the purpose of permitting engagement with the one or more support members 20 (to be described hereinafter).

The appliance support 1 of the present invention also includes at least two support members 20 which are adapted to be adjustably engaged with the brace member 2 so as to extend outwardly therefrom for the purpose of supporting an appropriate appliance and the like.

The support members 20 each include at least an elongate and substantially upright portion 21 and an outwardly extending base portion 22.

The upright portion 21 and base portions 22 can be integrally formed one with the other, or alternatively can be fabricated as separate members and connected or engaged one to the other by means of suitable braces, rivets, screws and the like.

The outwardly extending base portions 22 of the support members 20 are elongate in formation and are adapted to support an appropriate appliance. The uprights 21 extend upwardly at substantially right angles to the longitudinal axes of the base members 22 and are adapted at their upper portions 21*a* to be adjustably engaged with the brace member 2.

In the preferred form of the invention and referring in particular to FIG. 3 of the accompanying drawings, the uprights 21 are substantially "U" shaped in formation and are provided on a front face thereof with a lateral groove or slot 24. This groove or slot 24 passes across the front face of the uprights. The groove or slot 24 is preferably adjacent the top of the upright 21 but spaced apart therefrom.

Referring in particular to FIGS. 1, 2 and 3 of the accompanying drawings, when it is desired to engage the upright 21 of a support member 20 with the brace member 2, the upper portion of the upright 21 is engaged or located within the spacing or opening 15 within the brace member 2, so that the rail portion 10 of the brace member 2, slidably passes through the groove of slot 24 in the upper portion of the upright 21. One or more appropriate screw holes or the like 26 are provided in the front face of the upright 21 which will come into substantial alignment with one or more of the holes or slots 9 in the front face 5*a* of the location portion 5 of the brace member 2. An appropriate screw or the like can be passed therethrough so as to securely locate the upright 21 in its desired position.

As will be appreciated, the support members 20 are therefore held in a desired position relative to the brace member 2 by slidably engaging within the brace member 2, the rail portion 10 engaging within the groove or slot 24 within the upper portion of the upright 21. Securing means are then used to locate the support member 20 in a desired position relative to each other.

Rear surfaces of the uprights may also abutt against a wall or surface to which the support is attached, so that on any weight being placed on the outwardly extending base portions 22, this will be applied against the wall.

As shown in the accompanying drawings, the front face 5*a* of the location portion 5 is provided with a plurality of elongate holes or slots 9 to enable the spacing of the support members 20 relative to the brace plate 2 and to each other to be adjusted. For example such adjustment may be necessary, depending on the size, width, weight and the like of any appliance.

If following use with one appliance the support 1 is to be used with some other appliance, a securing pin, screw or bolt can be removed, and one or more of the support members 20 moved or slid laterally, until the hole 26 in the upper portion of the upright 21 of the support members 20 is aligned with one of the holes or slots 9 in the location portion 5. Securing screws, pins or the like can then be relocated to secure the support member(s) 20 in the desired position.

Figure 4:
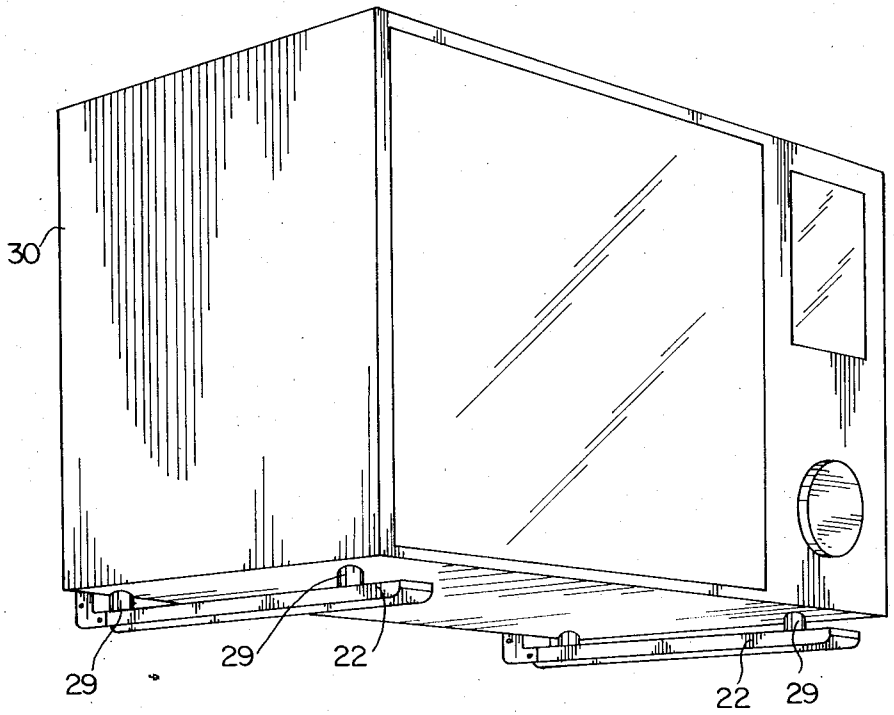
FIG. 4: is a perspective view of the present invention in use, mounting an appropriate appliance.

As will be appreciated from the accompanying drawings, and in particular FIGS. 1 and 4 thereof, the base portions 22 which extend outwardly from the uprights 21 of the support members 20 are elongate in formation and are adapted to locate and house an appliance 30 or the like.

In one form of the invention, the upper surface of the base portions 22 can be formed or provided with one or more indents or recesses 27, such as to carry and locate the feet 29 or the like of an appliance 30. This is by way of example only however. It will be appreciated however, that this assists in a secure and positive location.

The invention is described by way of example, to being provided with two support members 20. If desired, more than two such support members can be provided. For example, three, four or five. This is by way of example only however. Further, the uprights 21 can, if desired, be provided or formed with a plurality of lateral slots or grooves 24.

The present invention has been described by way of example only, and improvements and modifications may be made without departing from the scope or spirit thereof, as defined by the appended claims.

I claim:

1. An appliance support including an elongate brace member for attachment to a wall or similar surface, and at least two support members for supporting the appliance; the brace member including an attachment plate and an outwardly extending flange; each support member including an elongate and substantially upright portion and an outwardly extending base portion; the support members and the outwardly extending flange having complemental formations for providing support for each support member at longitudinally adjustable positions on the brace member, wherein the formation on the outwardly extending flange includes a downwardly extending portion extending downwardly of the outwardly extending flange and at right angles thereto; and an inwardly extending portion extending inwardly from the downwardly extending portion and spaced apart from and below said flange and wherein the formation on the upright portion of each support member comprises a transverse groove extending thereacross adjacent an upper end thereof for slidably receiving the said inwardly extending portion on the flange.

2. An appliance support including and elongate brace member for attachment to a wall or similar surface, and at least two support members for supporting the appliance; the brace member including an attachment plate and an outwardly extending flange; said outwardly extending flange including a downwardly extending portion extending downwardly of the outwardly extending flange and at right angles thereto; and an inwardly extending portion extending inwardly from the downwardly extending portion and spaced apart from and below said flange, each support member including an elongate and substantially upright portion and an outwardly extending base portion; an upper portion of each support member comprising a transverse groove extending thereacross, adjacent an upper end thereof, the arrangement being such that said inwardly extending portion of the flange slidable engages with said transverse groove in the upright portion of each support member.

* * * * *